US008700211B2

(12) United States Patent
Shoenfeld

(10) Patent No.: US 8,700,211 B2
(45) Date of Patent: Apr. 15, 2014

(54) SLIDE BAR LOCKING DRAWER FOR MEDICATIONS CABINET

(75) Inventor: Norman A. Shoenfeld, Livingston, NJ (US)

(73) Assignee: S & S X-Ray Products, Inc, Pen Argyl, PA (US)

( * ) Notice: Subject to any disclaimer, the term of this patent is extended or adjusted under 35 U.S.C. 154(b) by 260 days.

(21) Appl. No.: 13/291,462

(22) Filed: Nov. 8, 2011

(65) Prior Publication Data

US 2013/0112703 A1 May 9, 2013

(51) Int. Cl.
*G06F 17/00* (2006.01)

(52) U.S. Cl.
USPC ..... 700/242; 700/237; 700/236; 221/151

(58) Field of Classification Search
USPC ..... 312/215; 700/236, 237, 242
See application file for complete search history.

(56) References Cited

U.S. PATENT DOCUMENTS

| | | | | |
|---|---|---|---|---|
| 988,793 | A | 4/1911 | Lewis | |
| 1,247,137 | A | 11/1917 | Muennich | |
| 1,925,199 | A | 9/1933 | Mills | |
| 2,486,460 | A | 11/1949 | Bonenberger | |
| 6,011,999 | A | 1/2000 | Holmes | |
| 6,109,774 | A | 8/2000 | Holmes et al. | |
| 6,116,461 | A | 9/2000 | Broadfield et al. | |
| 6,338,007 | B1 | 1/2002 | Broadfield et al. | |
| 7,040,504 | B2 * | 5/2006 | Broadfield et al. | 221/98 |
| 7,426,425 | B2 * | 9/2008 | Meek et al. | 700/242 |
| 7,657,344 | B2 * | 2/2010 | Holmes et al. | 700/242 |
| 7,909,418 | B2 | 3/2011 | McFarland | |
| 8,197,017 | B2 * | 6/2012 | Rahilly | 312/215 |
| 8,335,588 | B2 * | 12/2012 | Rahilly et al. | 700/242 |
| 2009/0224638 | A1 * | 9/2009 | Weber | 312/222 |
| 2010/0301716 | A1 | 12/2010 | Ranitlla | |
| 2011/0196538 | A1 | 8/2011 | Michael | |

* cited by examiner

*Primary Examiner* — Timothy Waggoner
(74) *Attorney, Agent, or Firm* — Bernhard P. Molldrem, Jr.

(57) ABSTRACT

A controlled access pharmaceutical storage cabinet has at least one pull-out drawer that is divided into a number of locked compartments, arranged in rows. A slide bar lock is positioned between rows of the compartments, and has a series of slots along each edge which align with lock pins on hinged lids or covers for the compartments. Only one compartment can be opened at a time. A gear-motor is provided for each slide bar to move the slide bar to a position for access to a given compartment.

16 Claims, 9 Drawing Sheets

SLIDE BAR LOCKING DRAWER FOR MEDICATIONS CABINET

BACKGROUND OF THE INVENTION

This invention relates to cabinets for storing and dispensing prescription medications, non-prescription pharmaceuticals, medical supplies and other similar items for patient care in a hospital, clinic, nursing home, or similar health care facility. The invention is more specifically directed to a medical dispensing cabinet, with one or more pull-out drawers in which medical items are stored in individual compartments, which compartments may have locking lids or covers. The invention is more particularly concerned with a cabinet with limited access and with accountability of access and dispensing, and which may assist in the prevention of fraudulent access and reduction of medical errors.

In any hospital or clinic, or in wards or floors of the hospital or health center, controlled access cabinets are used for storage of pharmaceuticals and of other limited-access medical supplies. The medications prescribed for patients need to be conveniently accessible for the authorized nurse staff, but also need to be protected from unauthorized access of prescription medications, controlled substances, and high-value medical supplies. Dispensing cabinets typically have a stack of pull-out drawers that each have a number of compartments. Any practical cabinets of this type simply have drawers divided into compartments with no control of access once the drawer has been opened. In some of these there is a locking or latching mechanism associated with the individual lids.

The compartments may be filled or replenished by pharmacy staff, and later accessed by nursing staff to administer items to patients.

The cabinet may be of a suitable size for containing a variety of medical supplies and medications in amounts proper for the day to day needs of the medical staff and patients. For example, tall medical supply cabinets are commonly used in many health care facilities, with locking doors for limited access to some items, and locking drawers, each with several rows of divided compartments, for storage of prescription medications, non-prescription medications and supplies, hypodermic needles and syringes, and other materials that may be needed.

It is desirable to maintain a record of which supplies and which medications are stored, and in what quantities, in which locking or non-locking compartments of one or more of the drawers, and to unlock the one specific compartment lid for a given medication or supply item when it is needed to access the same to administer to a given patient.

In some cases, only dividers are present in the drawers and it is then not possible to limit access for specific compartments within the drawer.

These locking cabinets often incorporate USB connections (for access to a computer) and may incorporate control circuitry with software for controlling unlocking functions and inventory functions. These may be capable of IP addressable configurations, for access over a hospital network, to a personal computer, tablet, or hand-held device.

In the case of a multiple-compartment pull-out drawer, either in a floor-standing cabinet, a wall-mounted cabinet, or a portable cart, there may be respective tops or lids, each covering a divided section or compartment in the drawer. LED lights may be used to indicate whether a given compartment is unlocked and open. Sensors in each compartment may provide open-closed status for the compartments, and this permits the cabinet to capture an audit trail of which compartment has been opened, and by whom. In the past, these compartments were non-locking, but it was possible to sense and track which compartment had been accessed. Until the present, drawers divided into individual compartments with locking lids have employed rather complex locking systems, with individual latches, releases and actuators for each compartment lid.

OBJECTS AND SUMMARY OF THE INVENTION

Accordingly, it is an object of the present invention to provide a medical dispensing arrangement that avoids the drawbacks of the prior art.

It is another object to provide a medications cabinet with one or more pull-out drawers, divided into individual compartments, and each with a locking lid or cover, to limit authorized access to a specific medication only at one given time, to the pharmacy technician or to the nurse accessing the cabinet.

It is still another object to provide a cabinet that limits access to only one compartment of the drawer at a time, and which denies access to any other compartments at the time the drawer has been opened. This functionality is preferable, to limit access to only a single medication, and in doing so help reduce patient medication errors. It is also preferable for drawers containing narcotic medications to limit access to only the one medication prescribed.

It is a more specific object to provide a locking medication cabinet in which the locking mechanism of the drawer's compartments is a straightforward, electro-mechanical design, of a limited number of parts, and which overcomes the defects of the drawbacks of the prior art Other objects include database control over the locations of the medications; fast retrieval of prescriptions; rapid and accurate fill of prescriptions; and database-provided restocking of medications.

In accordance with an aspect of the present invention, a medication dispensing system involves a controlled access pharmaceutical storage case that comprises a frame and at least one pull out drawer slidably supported in the frame of the cabinet. The drawer includes a plurality of storage compartments arranged in at least one pair of parallel rows in the direction from back to front of the drawer. An elongated channel portion extends in the back to front direction between the rows of each pair of rows of compartments. Each of the storage compartments has a lid that is normally locked down but is selectively releasable to permit the lid to open for access to the compartment. The lid may be made of a clear, durable plastic so that the contents of the compartment are visible when the drawer is pulled out. The lid may also be made of an opaque material (plastic or metal), to prevent the person accessing the cabinet from seeing what is stored in other locked compartments within the open drawer. Each lid has a hinge pin at its rear portion. This permits the lid to pivot from a lowered closed position to an raised open position. A lock pin extends from one edge of the lid into said channel portion.

A slide bar disposed in said channel portion is adapted for motion, for at least a limited distance along the channel portion. The slide bar has slots along its side edges and these slots align with the respective lock pins of the compartment lids when the slide bar is moved to different positions along its associated channel. The respective compartment lid, for which the lock pin aligns with its associated slot, may be lifted open, but the remaining lids in that pair of rows are blocked from opening.

A controlled gearmotor device moves the slide bar to selected positions to align a given slot of the slide bar with the lock pin of a selected one of the compartments. This permits the associated lid to be lifted open but the other compartments in that pair of rows remain locked and are blocked from opening.

The present invention individually locks each of the divided compartments within each drawer, allowing access to only one divided section of the drawer at a time. This allows only one medication to be available at one time to the pharmacy technician or nurse accessing the cabinet. The user will not have access to the entire contents of a drawer when opened. This reduces the opportunity for the administration of a different, wrong medication for a given patient.

Favorably, the gearmotor is controlled to move the slide bar only when the drawer is closed, and is inhibited from moving said slide bar when said drawer has been pulled open, as a means to prevent access to more than one compartment at any one time.

The above and many other objects, features, and advantages of this invention will become apparent from the ensuing description of a selected preferred embodiment, which is to be considered in connection with the accompanying Drawing.

DETAILED DESCRIPTION OF THE PREFERRED EMBODIMENT

Figure 1:
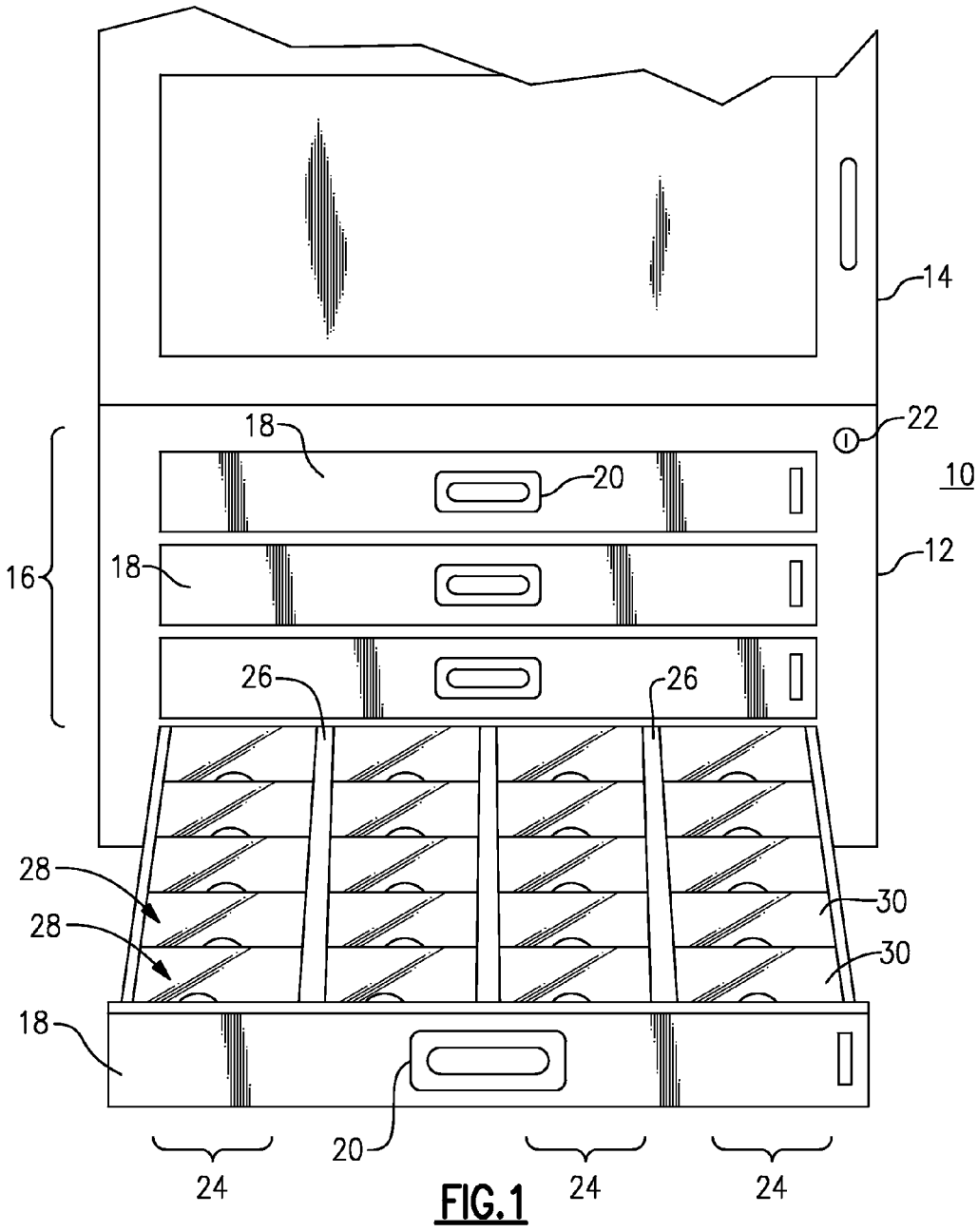
FIG. 1 is a perspective view of a medical dispensing cabinet according to one preferred embodiment of this invention, here showing one drawer having been pulled out to an open position.

With reference to the Drawing, and initially to FIGS. 1 to 4, a medication dispensing cabinet 10 can be a free-standing cabinet, wall-mounted cabinet, or portable cabinet mounted on wheels, and here has a generally vertical frame 12 having an upper storage compartment 14 with a locking swing-open door and below that a rack 16 of pull out drawers 18. Here one drawer 18 is shown as having been pulled open. There is a handle or pull 20 at the proximal end or front of the drawer 18. A key-operated lock 22 may be located on the cabinet and can serve as a pharmacy over-ride or emergency override. The drawer 18 is divided into individual locked compartments, here arranged as four rows or files 24, with a divider channel 26 between a left-side pair of rows 24 and a similar divider channel 26 between the rows 24 of a right-side pair. A middle divider channel 126 separates the second and third rows of compartments. Each row 24 has a series of compartments 28, each of which has a pivoted locking lid 30. Preferably, the lids 30 are each formed of a durable, rigid transparent plastic resin, so that the contents of the compartment are easily visible to the user, i.e., nurse, when the user accesses the compartments for administration of a medication or medical item to a patient.

Figure 2:
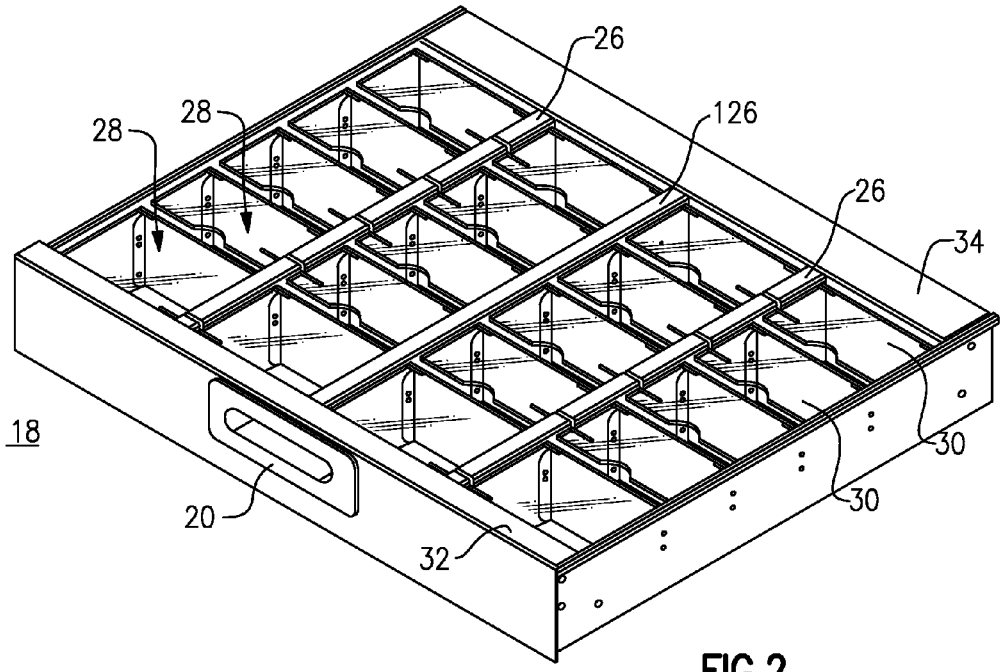
FIG. 2 is a front perspective view of the medical dispensing drawer with individual compartments.

Turning to FIG. 2, the drawer 18 is shown having front or proximal wall 32. This wall 32 is thick enough to allow for play or movement of locking slide bars to be discussed shortly. There is also a rear or distal wall 34 which contains drive motors or gear motors for the compartment unlock mechanism, also to be described below.

Figure 3:
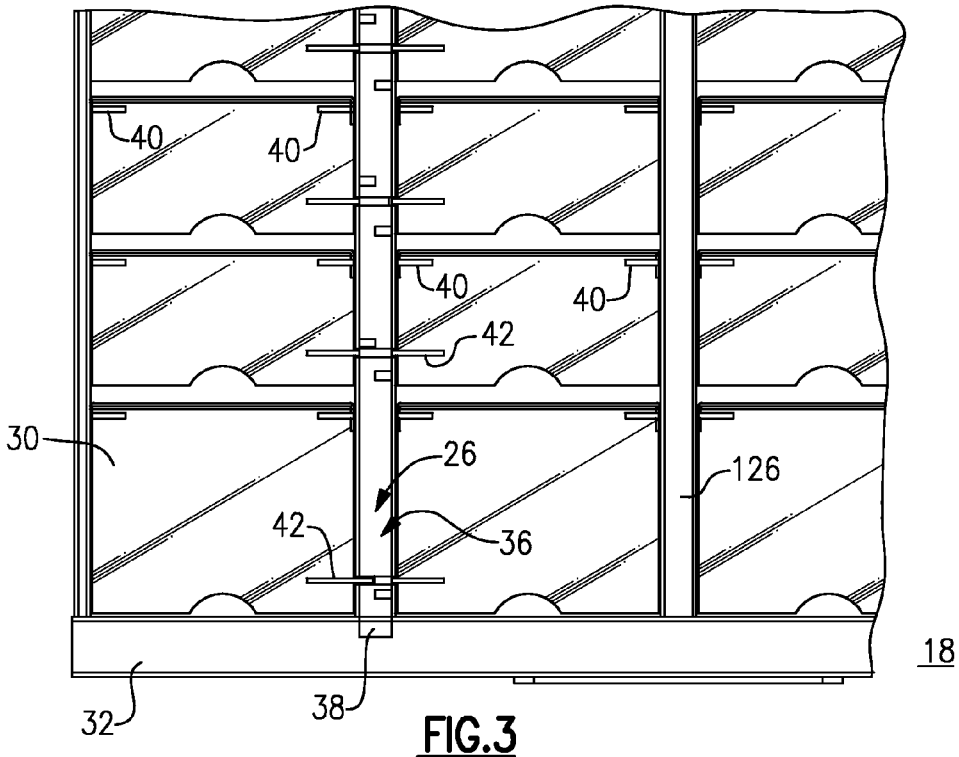
FIG. 3 is a top plan view of a portion of the drawer.
Figure 4:
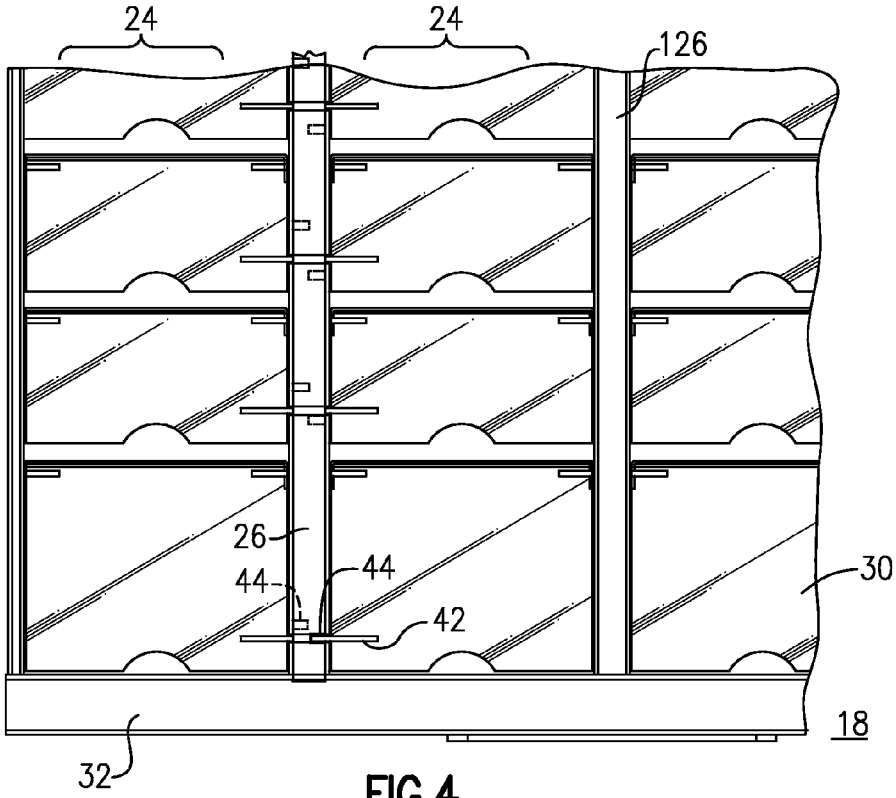
FIG. 4 is a top plan view thereof showing the locking bar positioned to access one given compartment.
Figure 9:
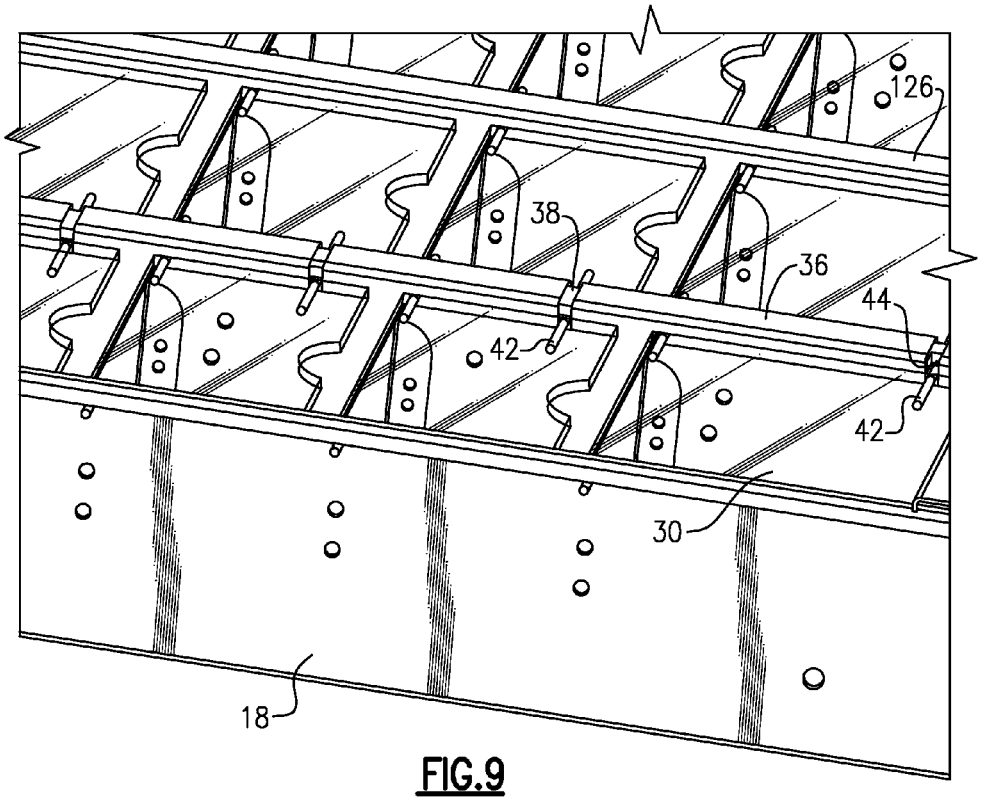
FIG. 9 is a perspective view of a portion of the dispensing drawer, for explaining the action of the locking and unlocking of the compartment lids thereof.

The locking bar or slide bar arrangement can be explained in respect to FIGS. 3 and 4. These two views show the left front portion of the drawer 18, showing left pair of rows 24 of compartments 28, the two rows being separated by the lock channel 26. The middle channel 126 is shown between the right row of compartments and the left row of the other pair of rows of compartments. As shown here, the slide bar 38 is positioned beneath the cover 36, and can be actuated to move in increments in forward (proximal) and rear (distal) directions. Each of the compartment lids 30 has a pair of hinge pins 40, 40 which extend into the associated channel and/or side wall of the drawer, and each of the lids also has an indent in its forward edge to serve as a pull lid and to facilitate the nurse or other authorized person in lifting the lid open. As seen in FIGS. 3, 4 and 9, there are no springs on the lids 30 or hinge pins 40, so the lids 30 remain down when the drawer is pulled out, and must be lifted up to open. Each lid 30 also has a lock pin 42 that is embedded in the front portion of the lid and which extends sidewards into the associated slide lock channel 26. In FIG. 3, the slide bar or lock bar is positioned so that a slot in the bar aligns with the lock pin 40 of one of the compartment lids 30, here lid 30 of the front compartment in the first or left-most row. FIG. 4 shows the slide bar 38 moved to another position where the slide bar 38 blocks the lock pin of the left-front compartment, but has a slot that now aligns with the lock pin of the lid 30 of the front bin in the second row. The cover 36, which does not itself move, has slots or openings aligned with each of the locking pins 42. The slide bar has a plurality of slots on each side edge over the length of the bar so that a different slot will align with lock pin for each of the lids of the first and second rows at different positions of the slide bar. When the slide bar is in a position to allow a particular bin or compartment to be opened, the lids 30 to all the other bins or compartments in that pair of rows 24 are held locked. In other embodiments, the lock pins 42 could be molded or forged integrally with the associated lid 30.

Figure 5:
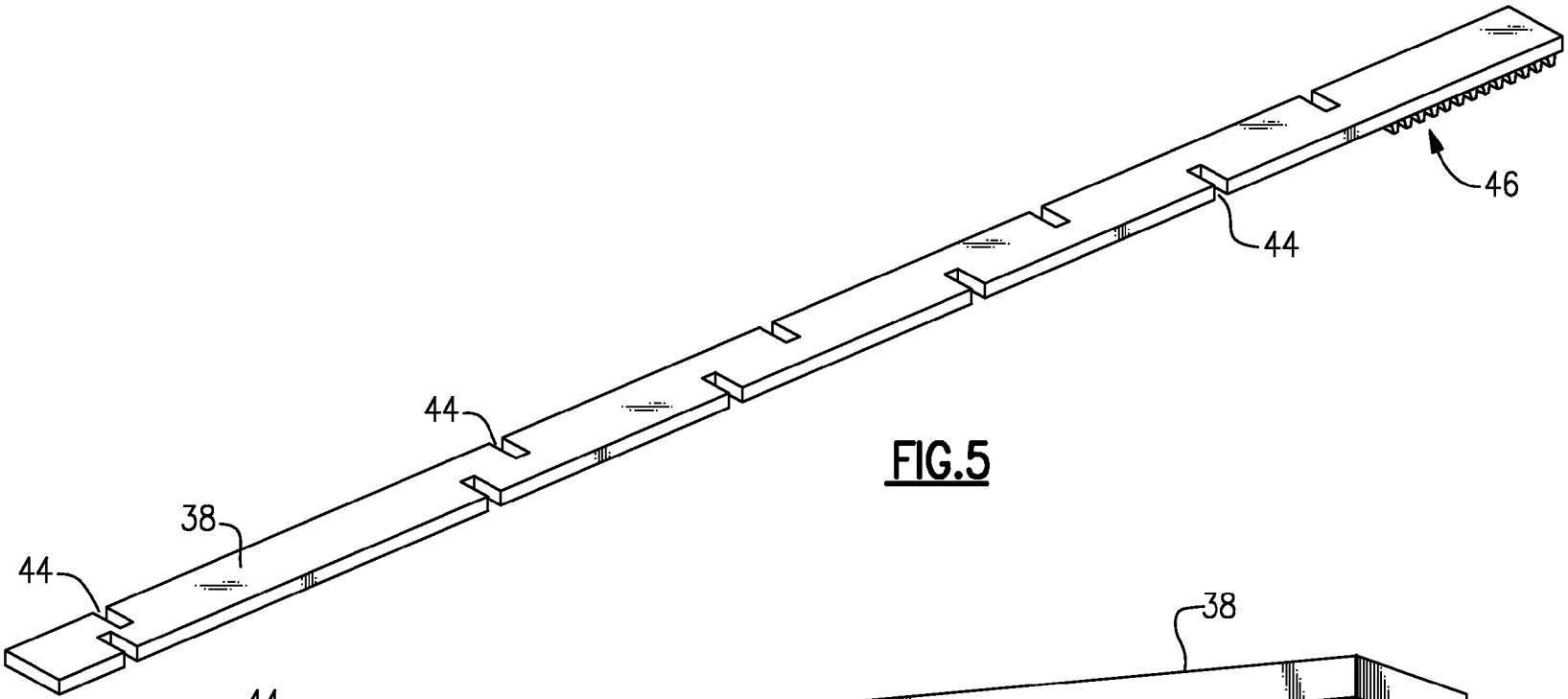
FIGS. 5 and 6 are perspective views that show features of one example of the sliding bar of this embodiment.
Figure 6:
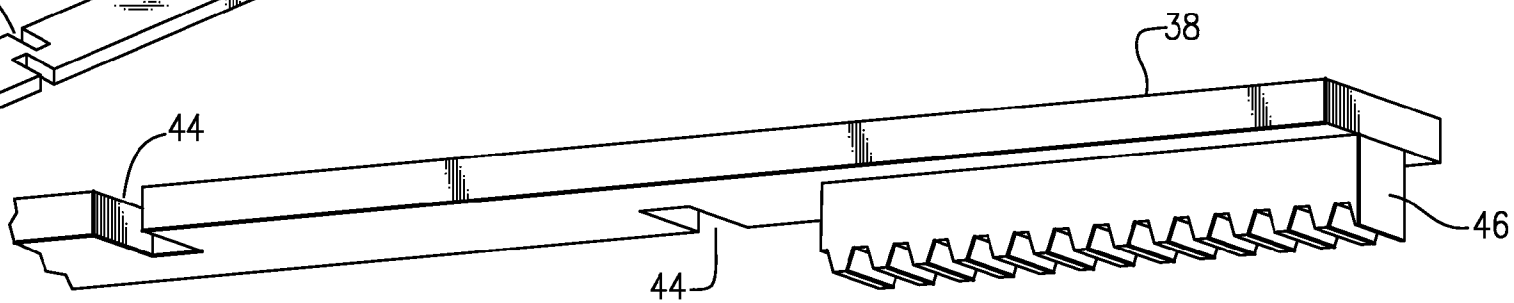

An example of the slide bar or lock bar 38 employed in this embodiment is shown in FIGS. 5 and 6. The slide bar 38 is an elongated, flat bar of anodized aluminum with left and right edges, and in which there are slots 44 formed at predetermined locations along each of the two edges. The positions of these slots are selected that a single compartment lid 30 will be unlocked at any one position, that is, the slots each align with only one lock pin 42 and this occurs at only one predetermined position at a time for the slide bar. At the rear or distal end of the bar, there is a gear rack 46 affixed, which is driven by a gear motor to be explained just below.

The slide bar 38 in this embodiment has its slots 44 positioned so that as the bar 38 is moved in 3/16 inch increments, the different slots 44 will align with their respective lock pins 42, one lock pin at a time. There are two such slide bars 38 each associated with one of the two pairs of rows of compartments. Each of the slide bars is calibrated to have eleven (11) positions, that is, one position for each of the ten compartments in the two rows, and one position at which all the compartments are locked.

Figure 7:
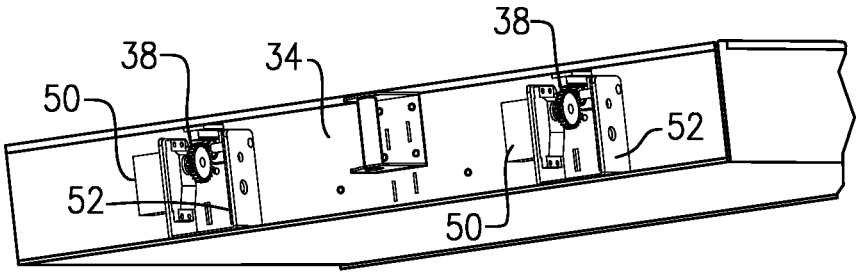
FIG. 7 is a rear perspective view of the medical dispensing drawer showing a pair of gear motors for actuating the associated slide bars.
Figure 8:
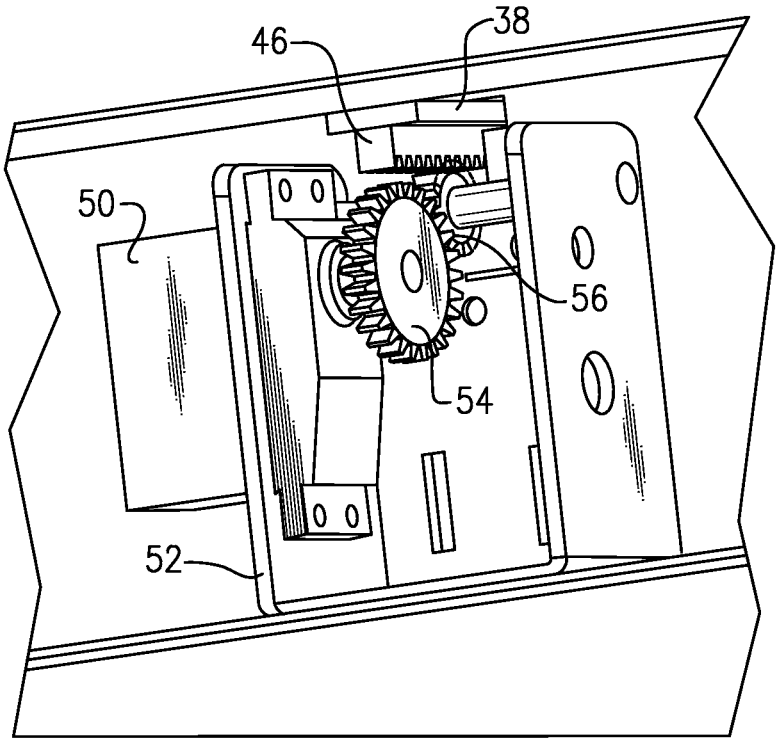
FIG. 8 is an enlarged view of one of the gear motors.

As shown in FIG. 7, there are two gear motors 50, 50 positioned within the back or distal wall 34 of the drawer 18. Each gear motor 50 has a gear drive that meshes with the gear rack 46 of the associated slide bar. The gear motors are independently controlled by logic and control circuitry, not shown in detail here. The details of the gear motor 50 and associated gear drive are shown in FIG. 8.

Each gear motor 50 is mounted on a frame or bracket 52 that is fastened onto the drawer distal wall 34. A motor drive gear 54 meshes with a slave pinion 56 that is journalled on the frame, and this pinion 56 meshes with the gear rack 46 of the slide bar at a position above the frame or bracket 52 of the gear motor. The gear motor is indexed to move in increments so as to align the bar with the one of the slots 44 positioned to align with the lock pin 42 for the lid of a desired bin or compartment 28. The logic and control circuitry can be driven by an associated computer or similar device that has a memory containing the identity of contents of each of the bins or compartments in the drawer so that the slide lock bar 38 will be moved to the appropriate location to access the medications for a particular patient, based on the prescription data stored to that patient. There are additional holes on the wall of the frame or bracket, for mounting additional gearing, encoder or potentiometer, e.g., for positioning or locating purposes, as will be discussed. Not shown in FIG. 8 are slots in the bottom of the gear motor bracket 52, which are used as part of the calibration process to adjust the locking bar to the proper position.

Figure 10:
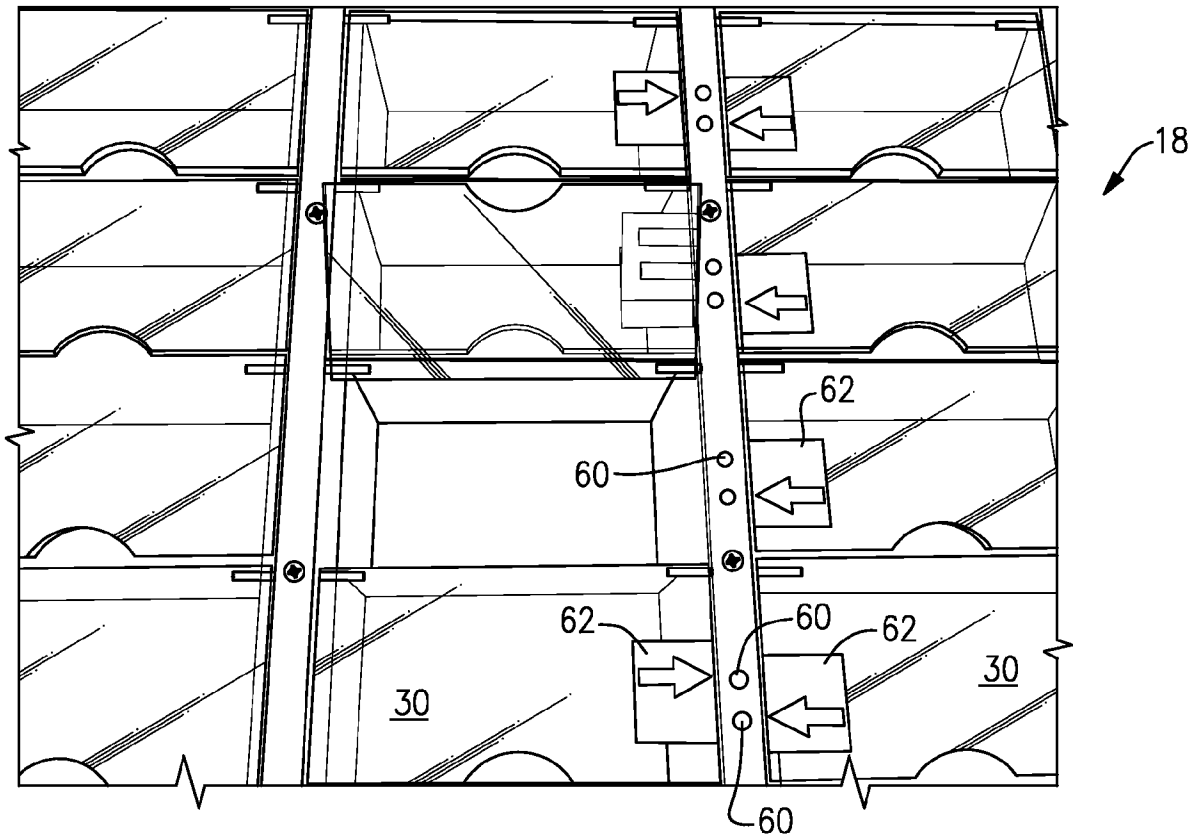
FIG. 10 is another perspective view thereof, showing one of the lids thereof being opened to allow access to the associated compartment.

The operation of the drawer 18 can be explained in reference to FIG. 9. When a particular medication is needed, e.g., for a patient prescription, and the medication is stored in one of the locked compartments 28 within one of the drawers 18 of the cabinet, the gear motor 50 behind the specific drawer is actuated, and moves the slide bar 38 to the position to allow opening of the cover 30 over that specific compartment. This aligns the particular slot 44 in the slide bar with the lock pin 42 for that compartment. In this example, the lid 30 at the lower right is unlocked, and the associated pin 42 is exposed to view beneath the slot 44 in the slide bar. An optional LED light 60 arrangement (FIG. 10) includes LEDs 60 located along the divider(s) along the upper side, which can light up to indicate which bin or compartment has been unlocked. In this case, there may be an indicator arrow 62 on the cover 30 for the compartment that indicates that the cover on the right or left has been unlocked. In FIG. 10, the second lid in the row at the center of the view is shown open. In most cases, the pin 42 can be made visible (with a distinctive color) to identify the unlocked compartment when the associated slot 44 is aligned and exposes that pin. The lock pins can be anodized a bright color, e.g., red, for easy visibility when aligned with the respective slot 44 in the slide bar. Alternatively, the locking slide bar 38 can be anodized a distinctive color, so that it becomes obvious when a slot is aligned with a locking pin.

Another method of identifying the compartments would be employ numbered decals (e.g. numbered "1" to "20" where there are four rows of five compartments) placed on the respective lids 30, which would correspond to the identity of the compartment stored in software, so that a display would provide the number ("1" to "20") of the lid 30 that the user is directed to open.

Figure 11:
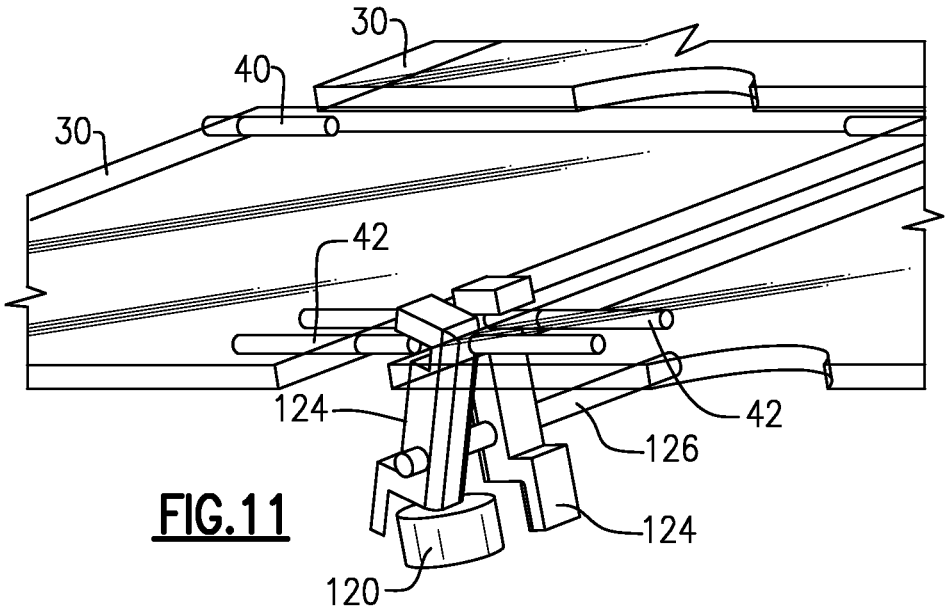
FIGS. 11 and 12 are perspective and plan views, respectively, of an alternative example of a locking mechanism for an embodiment of this invention.
Figure 12:
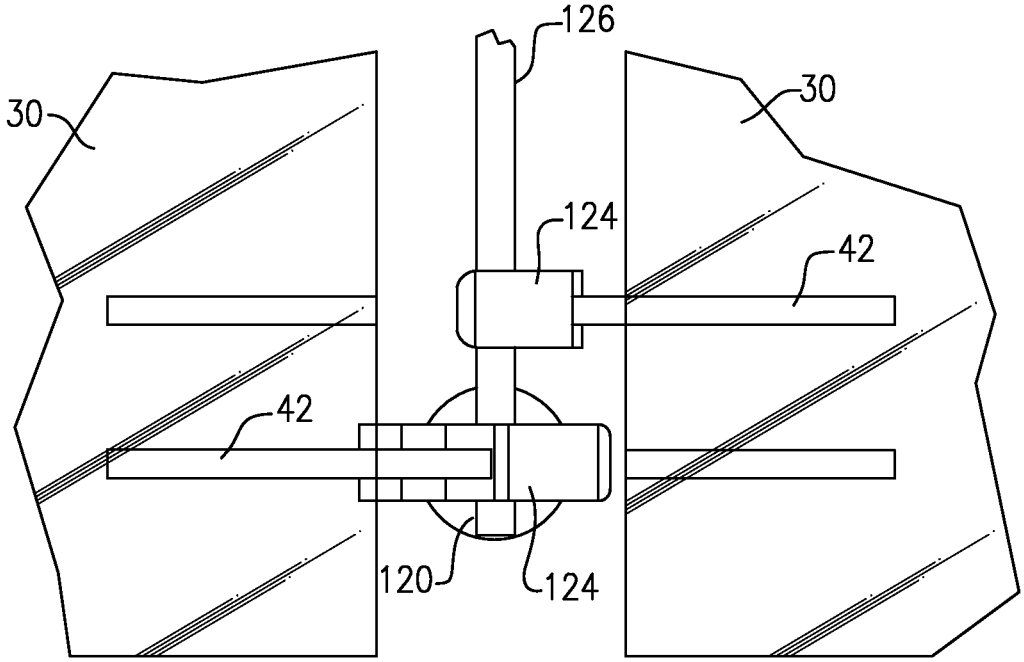
Figure 13:
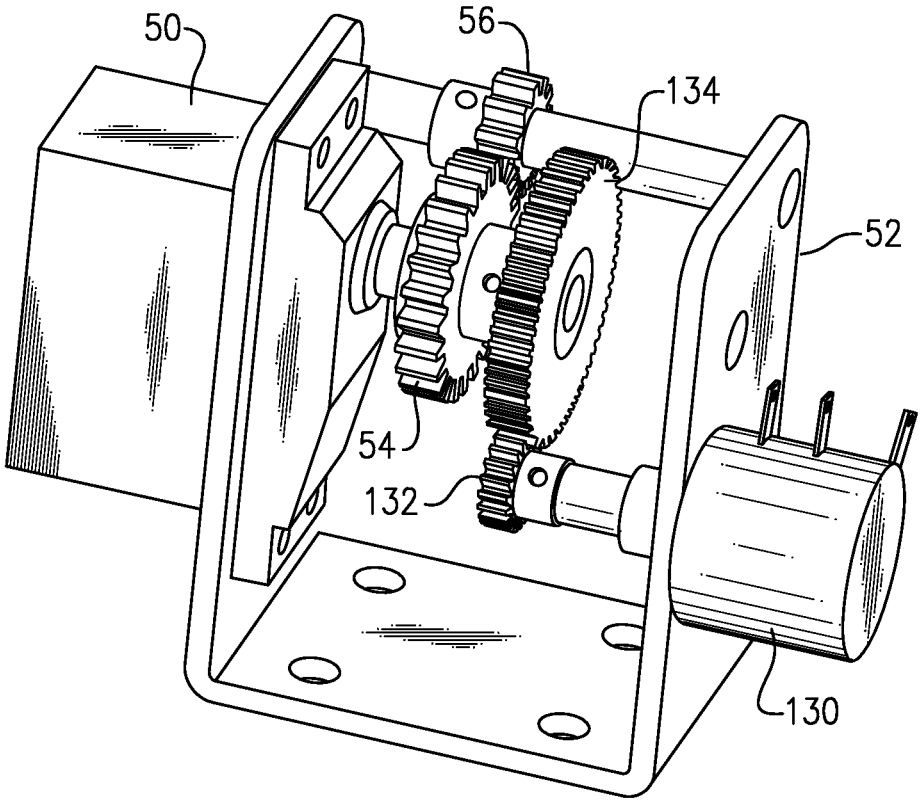
FIG. 13 is a perspective of the gearmotor employed in embodiments of this invention, here including an indexing potentiometer.

An alternative unlock mechanism is shown somewhat schematically in FIGS. 11 and 12, in which components that are the same as in the afore-described embodiment are identified with the same reference numbers. In this version, in place of the locking bar or slide bar there is a timing belt (not specifically shown) that moves along within the channel 26 between rows of compartments. A wheel or roller 120 is suspended from the timing belt and contacts a series of spring located hooks 124 each of which pivots on a horizontal axis 126 along the fore-aft direction of the drawer. The hooks 124 each cover one of the lock pins 42, but are pivoted out of the way of the associated lock pin when the roller 120 is moved to the position to unlock the associated compartment. The hook is pushed out to release the pin 42 so the particular lid or door 30 can be pulled open.

In the embodiments described here, the control circuitry is suitably programmed so that the locking bar or slide bar 38 is moved first before the drawer 18 can be unlocked and pulled open. That is, the slide bars only move when the drawer is shut and closed, so that only a single compartment can be accessed. In order to access a different compartment in the same drawer, for security the associated software requires that the drawer 18 be first shut and relocked by the user before another compartment in the same drawer can be accessed.

An advantage to the construction according to the embodiments of this invention is that only two gear motors 50 are required for the four rows of compartments, or in this embodiment, two (2) motors are sufficient to control the independent locking of twenty (20) bins or compartments, to ensure both security and authorized access. That is, each gear motor drive is associated with one slide bar 38, which provides access to each of the two associated rows of the pair of rows. This provides a durable, reliable lock and unlock mechanism for controlling access to the medications, and can be achieved at low to moderate cost.

While the embodiment herein-described employ one slide bar between each pair of rows, it is possible to employ a slide bar associated with a single row of compartments, or in some cases a slide bar associated with more than two rows of compartments.

Here, the control circuitry may include a computer controller (not specifically shown here), e.g., a standard lap top unit or touch screen tablet unit that may be incorporated into the cabinet 12 of supported on the cabinet, and may have a provision for entering prescription data and patient information. The computer unit may also require identity of the user, i.e., nurse or other caregiver, to create an audit trail of access to the various compartments. This may be done using ID code input, bar code scanning of ID's, proximity cards with RFID identification and password protection, and using biometric methods. The computer keeps track of the physical location of each filled prescription, i.e., each medication, within the cabinet. This can also be carried out, as an option, in an on-board processor or controller board.

Contact lens packages with lenses of various prescription strengths can also be stored and dispensed from an arrangement of this type. Other possible configurations are also possible, i.e., higher or wider than the embodiments described here. Also, the compartments may be divided in to compartments with the rows arranged left to right instead of back to front.

The arrangements and embodiments of this invention have the attribute of secure storage of multiple prescription medications, and achieve this in a small footprint, requiring little additional floor space. This arrangement has database control over the exact locations of the prescription medications, and achieves both quick storage and fast retrieval of the prescriptions. Bar coding for double-checking the prescriptions before dispensing can be carried out automatically or semiautomatically. Similarly, methods employing RFID identification of individual medications can also be used for security and prevention of mediation dispensing errors.

While the invention has been described hereinabove with reference to selected preferred embodiments, it should be recognized that the invention is not limited to those precise embodiments. In particular, in some preferred embodiments there can be a lockable front door anterior to the stack of lockable drawers, to provide an additional layer of protection for controlled substances located within the locked bins or compartments of the locked drawer. Rather, many modification and variations would present themselves to persons skilled in the art without departing from the scope and spirit of this invention, as defined in the appended claims.

What is claimed is:

1. A controlled access pharmaceutical storage case comprising a frame and at least one pull out drawer slidably supported in the frame of the cabinet; said drawer including a plurality of storage compartments arranged in at least one row that extends in a proximal-distal direction along said drawer and an elongated channel portion extending in said proximal-distal direction alongside said at least one row of compartments;

each of said storage compartments having a lid that is normally locked down but is selectively releasable to permit the lid to open for access to the compartment;

each said lid having a lid pull provided at a proximal side thereof and a hinge pin at a distal portion thereof and extending on a transverse pivot axis that is transverse to said proximal-distal direction to permit the lid to pivot from a lowered closed position to a raised open position; and a lock pin extending sidewards from one side edge of said lid into said channel portion, such that each of said lids may be lifted up from the proximal side and pivot up and distally on said transverse pivot axis, the lid and hinge pin being free of any spring device so that the lid does not open until lifted;

a slide bar disposed in said channel portion and adapted to move for at least a limited distance in the proximal-distal direction along said channel portion, said slide bar having slots along one edge thereof that align with the respective lock pins of said compartment lids when said slide bar is moved to different positions along said channel portion, and such that any compartment lid in which the lock pin aligns with its respective slot may be lifted open, but the remaining lids in that row are blocked from opening;

controlled motor means contained within a distal wall at a distal end of the drawer and engaging a distal portion of said slide bar that projects into said distal wall for moving said slide bar in its proximal-distal direction to selected positions to align a given slot of the slide bar with the lock pin of a selected one of said compartments to permit the associated lid to be lifted open but to lock each of the other compartments in said row from opening.

2. A controlled access pharmaceutical cabinet of claim 1 wherein said motor means is controlled to move said slide bar only when said drawer is closed, and is inhibited from moving said slide bar when said drawer has been pulled open.

3. A controlled access pharmaceutical cabinet of claim 1, wherein each said lid is planar and each with its respective hinge pins and said lock pin being embedded within the planar lid and projecting laterally therefrom.

4. A controlled access pharmaceutical storage case comprising a frame and at least one pull out drawer slidably supported in the frame of the cabinet and slidable in the direction from back to front; said drawer including a plurality of storage compartments arranged in at least one pair of parallel rows in the direction from back to front of said drawer and an elongated channel portion extending in the back to front direction between the rows of said pair of rows of compartments;

each of said storage compartments having a lid that is normally locked down but is selectively releasable to permit the lid to open for access to the compartment;

each said lid having a hinge pin at a back portion thereof and extending on a transverse axis that is transverse to said direction from back to front to permit the lid to pivot from a lowered closed position to a raised open position, such that the lids lift up from their front side and pivot upwards and back on their transverse pivot axis; and a lock pin extending from one edge of the lid into said channel portion, wherein the lock pins in one row of said pair of rows are on a right side of the lids thereof and the lock pins on the other row of said pair of rows are on the left side of the lids thereof;

a slide bar disposed in said channel portion and adapted to move for at least a limited distance along said channel portion, said slide bar having slots along both of its side edges which slots align with the respective lock pins of said compartment lids when said slide bar is moved to different respective positions along said channel portion, and such that any compartment lid in which the lock pin aligns with its respective slot may be lifted open, but the remaining lids in that pair of rows are blocked from opening;

controlled motor means mounted within a rear wall of said drawer for moving said slide bar to selected positions to align, at each selected position, a given slot of the slide bar with the lock pin of a selected one of said compartments to permit the associated lid to be lifted open but to lock each of the other compartments in said pair of rows from opening.

5. A controlled access pharmaceutical cabinet of claim 4 in which said compartments comprise two or more pairs of rows of said compartments, with a respective channel portion extending between the rows of each pair and with respective slotted slide bars disposed within said channel portions.

6. A controlled access pharmaceutical cabinet of claim 5, said controlled motor means including, for each said pair of parallel rows, a respective gear motor mounted within a rear wall of said drawer and coupled to the slide bar associated with a respective pair of said compartments.

7. A controlled access pharmaceutical cabinet of claim 6 wherein each said slide bar has a gear rack affixed onto a distal end thereof, and each said gear motor has a pinion meshing with the gear rack of the associated slide bar.

8. A controlled access pharmaceutical cabinet of claim 4, each said channel portion including a cover fixedly mounted on the drawer over the associated slide bar and not moving with said slide bar, said cover having slot openings on left and right sides thereof at locations of the lock pins of the respective lids of the pair of rows of compartments.

9. A controlled access pharmaceutical cabinet of claim 4, wherein said motor means is controlled to move said slide bars only when said drawer is closed, and is inhibited from moving said slide bars when said drawer has been pulled open.

10. A controlled access pharmaceutical cabinet of claim 4, comprising a control arrangement suitably programmed with audit trail software for recording each time of opening of the lid of any of said compartments and also recording identity of each person associated with such openings of such lids.

11. A controlled access pharmaceutical cabinet of claim 4, wherein said controlled motor means is operative to move said slide bar between a discrete number of positions equal to the number of compartments in the respective pair of parallel rows of storage compartments, plus a position in which all compartments are locked.

12. A controlled access pharmaceutical cabinet of claim 11, wherein said controlled motor means includes an indexed gear motor that is indexed to move the slide bar in increments so as to align the bar with a with a selected one of the slots thereof aligned with the lock pin for the lid of a selected compartment.

13. A controlled access pharmaceutical cabinet of claim 4, further comprising visual indicators mounted on the channel portion between the rows of said pair of rows, and means for illuminating a respective one of said indicators when a corresponding one of said lids is unlocked.

14. A controlled access pharmaceutical cabinet of claim 4, wherein the lids each have a lid pull provided at a front side thereof for lifting the lid open.

15. A controlled access pharmaceutical cabinet of claim 14, wherein the lids and hinge pins are free of any spring opening device so that the lids do not open until lifted.

16. A controlled access pharmaceutical cabinet of claim 4, wherein each said lid is planar and each with its respective hinge pins and said lock pin being embedded within the planar lid and projecting laterally therefrom.

* * * * *